United States Patent [19]

Bezak

[11] Patent Number: 4,509,748

[45] Date of Patent: Apr. 9, 1985

[54] FOOT HOLDING APPARATUS FOR SIT-UPS AND LIKE EXERCISES

[76] Inventor: Michael J. Bezak, 5203 First St., Versailles Boro, Pittsburgh, Pa. 15132

[21] Appl. No.: 510,902

[22] Filed: Jul. 5, 1983

[51] Int. Cl.[3] ..... A63B 23/02

[52] U.S. Cl. ..... 272/145

[58] Field of Search ..... 272/93, 145, 900, 139, 272/73, 138

[56] References Cited

U.S. PATENT DOCUMENTS

| | | | |
|---|---|---|---|
| D. 193,940 | 10/1962 | Campion | D34/5 |
| 1,905,019 | 4/1933 | Turner | 272/134 |
| 1,953,857 | 4/1934 | Hunter | 272/57 |
| 2,050,652 | 8/1936 | Fleming | 272/57 |
| 2,224,445 | 12/1940 | Parker | 272/138 |
| 2,759,730 | 8/1956 | Berry | 272/58 |
| 3,682,475 | 8/1972 | Walker | 272/145 |
| 3,947,023 | 3/1976 | Martin | 272/93 |
| 3,966,200 | 6/1976 | Kirk | 272/145 X |
| 4,182,510 | 1/1980 | Lundell | 272/93 |
| 4,185,816 | 1/1980 | Bernstein | 272/93 |
| 4,212,458 | 7/1980 | Bizilia | 272/93 |
| 4,241,915 | 12/1980 | Noble et al. | 272/144 X |
| 4,249,726 | 2/1981 | Faust | 272/123 |
| 4,282,868 | 8/1981 | Riggs | 272/116 X |

*Primary Examiner*—Robert A. Hafer
*Assistant Examiner*—Chris Coppens
*Attorney, Agent, or Firm*—Buell, Ziesenheim, Beck & Alstadt

[57] ABSTRACT

A compact and readily portable foot holding apparatus for performing sit-ups and like exercises is disclosed. The device has a general "T" shaped appearance formed from a flat cross bar member having a pair of foot holding straps thereon and a substantially flat elongated member. One end of the elongated member is designed to engage the top surface of the cross member in a manner such that when the user sits on the opposite end of the elongated member, the user's weight resists upward movement of the cross bar and foot straps. In some embodiments an exercise mat is incorporated for comfort and in all cases the apparatus can be easily assembled and disassembled without tools.

8 Claims, 6 Drawing Figures

FOOT HOLDING APPARATUS FOR SIT-UPS AND LIKE EXERCISES

BACKGROUND OF THE INVENTION

1. Field of the Invention

This invention relates to an improved exercising apparatus for restraining the feet during sit-ups and like exercises. More specifically, an elongated member on which the user sits engages the top surface of a cross bar member having a pair of foot holding means in a manner such that user's own weight prevents the cross bar member from lifting during sit-ups or similar exercises. In one embodiment, an exercise mat is incorporated and in all cases the apparatus can be easily dissassembled making it readily portable and compact for storage.

2. Description of the Prior Art

There are many known exercising devices which are designed to secure or restrain a user's feet during sit-ups. A large portion of those devices are designed to be secured to the bottom margin of a door. For examples of that type of device, see U.S. Pat. Nos. 4,182,510 and 4,212,458. Often times, however, there are no conveniently located doors on which such a device could be secured. Additionally, there are times when groups of people desire to perform exercises together. This is frequently the case with gym classes and sports teams. Few if any rooms are provided with a sufficient number of available doors to accomodate a large number of door mounted foot holding devices.

Devices which do not require door support are also known. For examples of those devices, see U.S. Pat. Nos. 1,905,019; 1,953,857 and 2,759,730. While those devices provide the advantage of being totally self containing, each of those devices is relatively large in size, cumbersome to move and requires substantial storage space. Of those patents, U.S. Pat. No. 1,905,019 is the most compact and easiest to store. That device, however, still does not provide sufficient portability to make it suitable for many uses.

SUMMARY OF THE INVENTION

I provide a foot holding means for sit-ups and the like which is inexpensive, compact and readily portable.

I prefer to provide an exercise device having an elongated member having one end on which the user sits and the other end of which engages the top surface of a cross bar member which is provided with a pair of foot holding means.

The weight of the user on the elongated member prevents the cross bar and attached foot holding means from lifting upwardly while sit-ups are being performed.

I prefer to provide elongated and cross bar members which are thin and narrow.

I prefer to provide an elongated member having one end recessed to receive the central portion of the cross member when the elongated member is engaged over the cross member.

I prefer to provide a cross bar member having straps or stirrups provided at each end thereof.

I further prefer to provide elongated and cross bar members which can be secured together for ease of handling.

Finally, in one embodiment I prefer to provide a mat for comfort having a sleeve and foot holding means at one end, a first elongate member provided in a manner to resist upward motion of the foot holding means when the user sits on the mat.

These and other advantages and features of the present invention will be more fully understood upon reference to the accompanying drawings in which I have illustrated certain present preferred embodiments of my invention.

DESCRIPTION OF THE PREFERRED EMBODIMENTS

Figure 1:
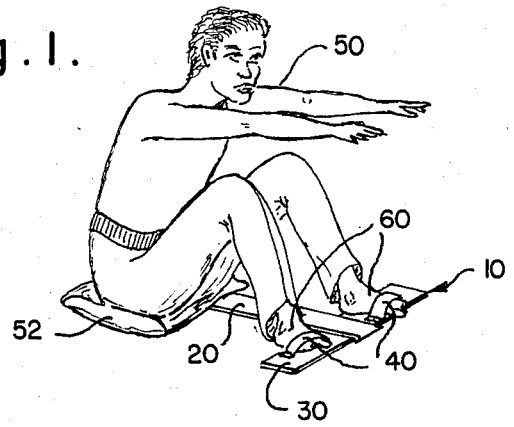
FIG. 1 is an isometric view of one form of the invention in use.
Figure 2:
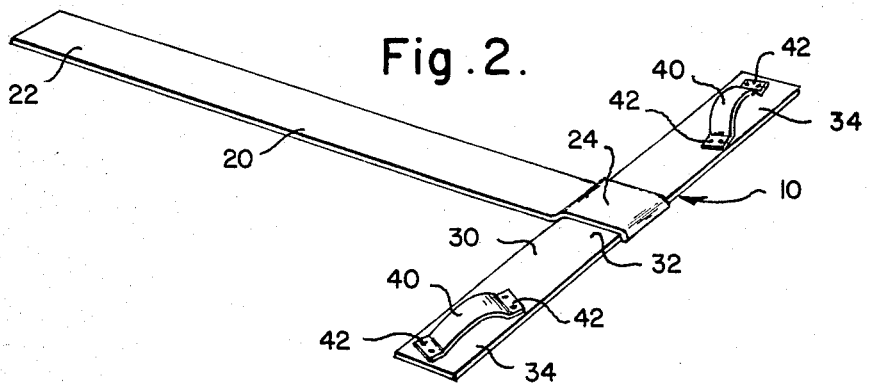
FIG. 2 is an isometric view of the structure shown in FIG. 1 showing an overlying elongated member and cross bar member having straps at each end thereof.

Referring specifically to FIGS. 1 and 2, one embodiment 10 if my foot holding apparatus is shown. The apparatus 10 is comprised of an elongated member 20 and cross bar member 30. Both elongated member 20 and cross member 30 are preferably fabricated from a light weight metal but any substance which can be formed into a rigid member, such as metal, wood or plastic will work. Members 20 and 30 are generally rectangular in shape and have a single top surface, and a single bottom surface. Members 20 and 30 have a relatively narrow width and thin thickness with respect to their length to make them light and more compact when disassembled. Members 20 and 30 are adapted to lie flat in a substantially horizontal plane in a manner so that substantially all of the bottom surface contacts a generally flat supporting surface, such as a floor, when the members are placed thereon.

One end 24 of elongated member 20 is formed into an upwardly extending inverted U-shaped channel sized to receive the cross member 30. A variety of other engaging means may be utilized but at least a portion of the elongated member 20 must engage the upper surface 32 of cross member 30 in order to prevent cross member 30 from lifting upwardly or being pushed beyond the end 24 of member 20. I prefer not to use screws or other similar connecting means so that the apparatus can be easily disassembled without the need for any tools. Each end 34 of cross member 30 is provided with a strap 40 or other foot securing means sized to receive and hold the front portion of the user's feet 60. Each end 42 of straps 40 are secured to cross member 30 as shown. The straps may be made from any flexible material such as leather, nylon or canvas and may be secured to cross member 30 in a variety of ways including screws, glue or even a suitable arrangement of velcro strips. A buckle or other size adjusting means may also be employed to make the straps 40 adjustable for use by both children and adults.

In operation, the user sits either directly or on a pillow 52 placed on end 22 of elongated member 20 and places his feet 60 into straps 40 as shown. The user's weight on elongated member 20 provides resistance to any upwardly directed forces applied to the cross member 30 by the user's feet 60. With this simple arrangement the user's feet can be held stationary and sit-ups can be effectively performed. After use, member 20 can simply be lifted upwardly, thereby, disassembling the apparatus 10 and the floor facing side of the cross member 30 can be rested and secured to the upper facing surface of member 20 by a strap or other means (not shown) making the apparatus 10 completely portable. Because of the compact and efficient design, it can be inexpensively mass produced and is ideal for both indoor or outdoor use. Additionally, because of its portability a large number of the devices may easily be transported to practice areas and fields for various team sports.

Figure 3:
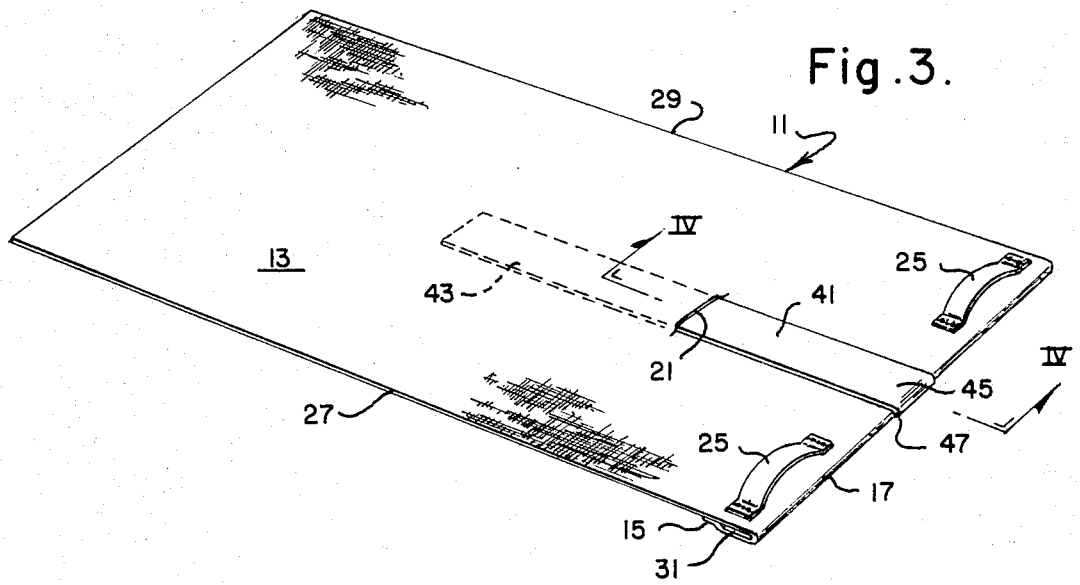
FIG. 3 is an isometric view of another embodiment of the present invention showing an exercise mat having straps attached at one end thereof.
Figure 4:
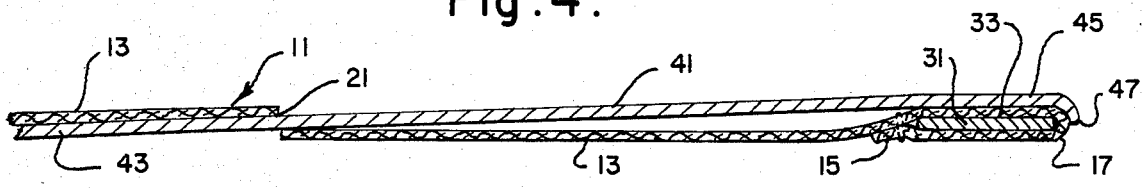
FIG. 4 is a cross-sectional view taken through IV—IV of FIG. 3 showing the orientation of the mat with respect to a first and second elongated member.

FIGS. 3 and 4 illustrate another embodiment 11 of the present invention. In this embodiment, an exercise mat 13 is provided for the comfort of the user. Mat 13 can be made of any flexible material and has a sleeve portion 17 at one end thereof The sleeve portion 17 may be formed by folding one end 15 of the mat 13 under and securing the end 15 to the mat by any suitable means. The upper facing surface of the sleeve portion 17 is then provided with flexible straps 25 as shown. Mat 13 is also provided with a slit 21 oriented parallel with respect to the sleeve 17 and located centrally between sides 27 and 29 of mat 13 at some distance away from the sleeve 17. A cross member 31 is inserted into sleeve 17 to add rigidity of the sleeve end of mat 13. A second elongated member 41 is also provided. One end 43 of member 41 is preferably inserted through slit 21 in a manner so that it extends away from sleeve portion 17 and rests underneath mat 13. The other end 45 of member 41 is provided with a downwardly extending tip 47 formed to rest on the central portion of sleeve member 17 thereby engaging the top surface of cross member 31 through the sleeve portion 17 of the mat as shown. When a user sits on the mat 13 over end 43 of elongted member 41 his weight will resist upwardly directed forces applied to the straps 25 and the apparatus will, therefore, hold the user's feet while he performs sit-ups. Alternatively, cross member 31 and elongated member 41 may be identical to members 20 and 30 described in connection with FIGS. 1 and 2.

Another embodiment of my invention (not shown) could include a modification of embodiment 11, wherein an elongated member corresponding to member 41 could be provided completely underneath 13 and cross member 31 having its engaging end bent upwardly to engage the forward facing end of sleeve 17. With this arrangement the end portion of the engaging end would then have to bend backward so as to either engage the upper surface 33 of cross member 31 through the mat or engage that surface directly by entering a slit cut in the sleeve 17.

Figure 5:
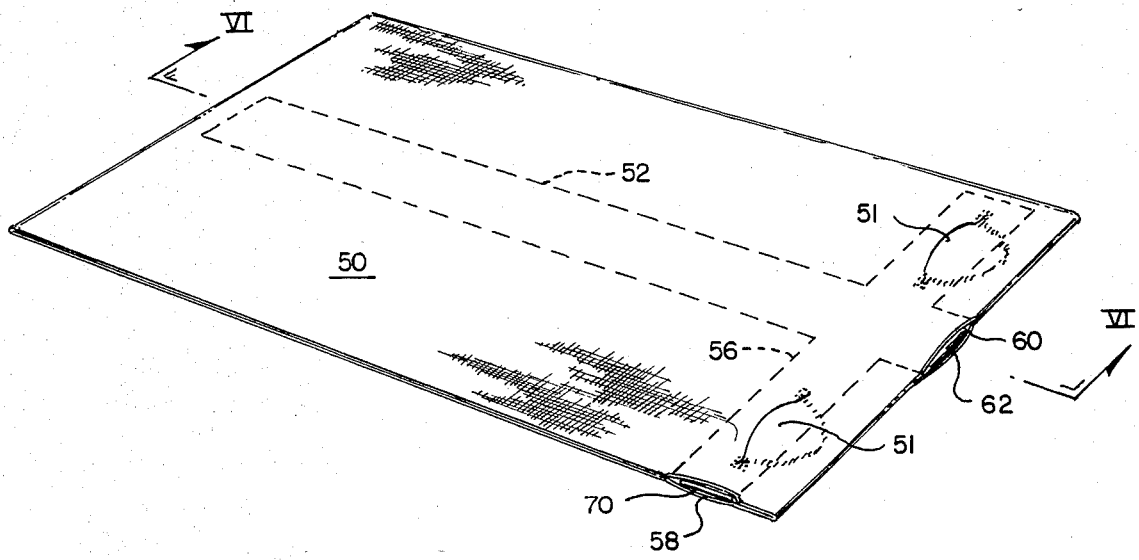
FIG. 5 is an isometric view of yet another embodiment of the present invention showing an exercise mat having sleeves therein to receive an elongated member and cross member.
Figure 6:
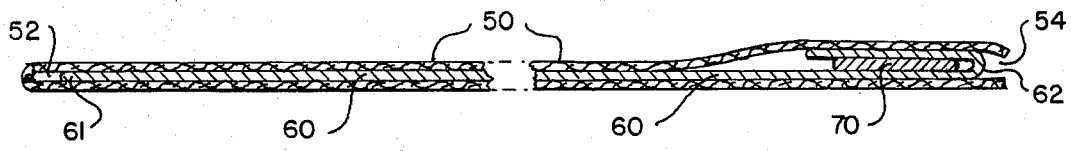
FIG. 6 is a cross sectional view taken through line VI—VI of FIG. 5.

FIG. 5 and FIG. 6 show yet another embodiment of my invention. A rectangular mat 50 having a pair of foot holding means 51 therein is formed to have a longitudinally disposed sleeve 52 centered therein, said sleeve sized to receive elongated member 60. Opening 54 in sleeve 52 allows insertion of member 60 into said sleeve. A transversely oriented sleeve 56 is also provided in said mat, said sleeve sized to receive cross member 70 and intersecting sleeve 52. Likewise opening 58 allows insertion of member 70 into sleeve 56. In use, mat 50 is placed in a desired position and end 61 of elongated member 60 is inserted through opening 54 into sleeve 52. Elongated member 60, which is preferably made of metal, has an opposite end 62 which is bent upwardly then backwardly as shown in FIG. 6. Next, a substantially flat cross member 70, also of metal, is inserted through opening 58 into sleeve 56 in a manner so that the upper and lower facing surfaces of cross member 70 engage end 62 of elongated member 60, as shown. It can be seen, therefore, that upwardly directed forces applied to said cross member are resisted by a mass applied to elongated member 60.

While I have shown and described certain present preferred embodiments of the invention and have illustrated a present preferred method of practicing the same it is to be understood that the invention is not limited thereto but may be otherwise variously practiced within the scope of the following claims.

I claim:

1. A foot holding apparatus for performing sit-ups and like exercises comprising:

(a) a rectangular mat adapted to lie flat in a substantially horizontal plane when placed on a generally flat supporting surface, said mat having a first sleeve portion therein extending across the width of the mat near one end thereof and presenting an uppwer sleeve surface, said mat also having a pair of spaced-apart foot holding means attached to the upper sleeve surface;

(b) a generally rectangular flat cross bar member having a single top and a single bottom surface, said member having a relative narrow width and thin thickness with respect to a length dimension thereof, said cross member adapted to lie flat in a substantially horizontal plane and to be inserted into the sleeve; and (c) a separate generally rectangular substantially flat elongated member having a single top and a single bottom surface, said elongated member having a relatively narrow width and thin thickness with respect to a length dimension thereof, said elongated member adapted to lie flat in a substantially horizontal plane and to be positioned over said cross member in a manner whereby at least a portion of one end of said elongated member engages the top surface of the cross bar at the approximate midpoint of the cross bar and an opposite end of the elongated member extends away from the sleeve and is positioned under the mat and upward movement of the sleeve portion of the mat and attached foot holding means is resisted by the mass of a user applied through the mat to the opposite end of the elongated member.

2. An apparatus according to claim 1 wherein said elongated member has one end which extends underneath said cross member and bends upwardly and backwardly to engage the top portion of said cross bar.

3. A foot holding apparatus according to claim 2 wherein the mat has a second sleeve extending longitudinally and centered therein, said first sleeve intersecting said sleeve and having said elongated member inserted therein.

4. A foot holding apparatus according to claim 1 wherein at least a portion of one end of the elongated member engages the top surface of the cross bar within the sleeve portion of the mat.

5. A foot holding apparatus according to claim 1 wherein at least a portion of one end of the elongated member engages the top surface of the cross bar through the sleeve portion of the mat.

6. A foot holding apparatus according to claim 5 wherein the mat has a narrow centered slit therein oriented parallel to the sleeve at some distance from the sleeve end of the mat and the engaging end of the elongated member has a downwardly bending end portion to receive and secure the sleeve as that end rests on the top of the sleeve and the opposite end of the elongated member extends away from the sleeve through the slit to rest underneath the mat.

7. A foot holding apparatus according to claim 1 wherein the foot holding means is a strap secured at each end thereof to the upper sleeve surface in a manner allowing entry of the front portion of a foot.

8. A foot holding apparatus according to claim 7 wherein the strap is adjustable.

* * * * *

UNITED STATES PATENT AND TRADEMARK OFFICE

CERTIFICATE OF CORRECTION

PATENT NO. : 4,509,748

DATED : April 9, 1985

INVENTOR(S) : MICHAEL J. BEZAK

It is certified that error appears in the above-identified patent and that said Letters Patent is hereby corrected as shown below:

Column 4, line 1, after "Likewise", insert --,--.

Column 4, claim 1, line 29, change "uppwer" to --upper--.

Column 4, claim 1, line 34, change "relative" to --relatively--.

Signed and Sealed this

*Twentieth* Day of *August 1985*

[SEAL]

*Attest:*

DONALD J. QUIGG

*Attesting Officer* *Acting Commissioner of Patents and Trademarks*